United States Patent [19]

Marksberry

[11] Patent Number: 4,686,959

[45] Date of Patent: Aug. 18, 1987

[54] THERMAL STORAGE FURNACE SYSTEM

[75] Inventor: Clarence L. Marksberry, Plymouth, Minn.

[73] Assignee: Electric Power Research Institute, Inc., Palo Alto, Calif.

[21] Appl. No.: 638,191

[22] Filed: Aug. 2, 1984

[51] Int. Cl.[4] ..... F24H 7/00

[52] U.S. Cl. ..... 126/400; 219/365; 219/367; 219/378; 165/18; 165/103; 126/430

[58] Field of Search ..... 126/400, 430, 431, 429; 165/18, 103; 219/378, 365, 364, 367; 237/1 R

[56] References Cited

U.S. PATENT DOCUMENTS

| | | | |
|---|---|---|---|
| 3,400,249 | 9/1968 | Mekjean et al. | 126/400 |
| 4,137,898 | 2/1979 | Kolzumi et al. | 126/400 |
| 4,203,424 | 5/1980 | Coxon et al. | 126/430 |
| 4,234,782 | 11/1980 | Barabas et al. | 126/400 |

*Primary Examiner*—James C. Yeung
*Attorney, Agent, or Firm*—James P. Hillman

[57] ABSTRACT

A thermal storage furnace system having a mixing means in fluid communication with both a thermal storage means and a thermal storage means bypass conduit for mixing both heated fluid from the thermal storage means and unheated fluid from the thermal storage means bypass conduit to provide for storage of heat in the thermal storage means at a first predetermined higher temperature than desired for heating the interior of the structure, while providing a second predetermined temperature fluid for space heating the interior of the structure by mixing the heated fluid from the thermal storage means with the unheated fluid from the thermal storage means bypass conduit.

4 Claims, 6 Drawing Figures

THERMAL STORAGE FURNACE SYSTEM

This invention was made under contract with or supported by the Electric Power Research Institute, Inc.

BACKGROUND OF THE INVENTION

1. Field of the Invention

The invention relates, in general, to a thermal storage furnace system for convention heating the interior volume of a structure or housing and in particular to a thermal storage furnace system having a mixing means for mixing high temperature fluid from a heat source with low temperature fluid from a low temperature fluid source, such as the return from the interior volume of the structure.

2. Description of the Prior Art

The electric utility industry experiences wide variations in their daily load cycle. During peak demand periods they generally use premium fuel to generate power. During minimum demand periods coal and nuclear generating plants are under utilized. As a result, utilities can offer electric power at reduced rates to their customers during the minimum demand time intervals in their daily load cycles.

A significant use of electric power during peak load periods is the direct conversion of electric energy to thermal energy. Apparatus is available which converts off-peak electric power to thermal energy, and stores it for use during peak demand time periods. These devices have generally been too costly to achieve general utilization, due in large part to the economic burden imposed by the large heat storage medium. Accordingly it would be desirable to have a thermal storage furnace system having a low cost thermal storage medium capable of being cycled to high storage temperatures and a means for delivering the high temperature heat stored therein to the interior volume of a structure at a lower temperature.

SUMMARY OF THE INVENTION

Briefly, the present invention is a novel thermal storage furnace system for convectively heating the interior volume of a structure or housing, by means of circulating a heated fluid, including a thermal storage means or chamber, a thermal storage means bypass conduit adapted for fluid communication with the interior volume of the structure to be heated and in fluid communication with the thermal storage chamber for routing the return unheated fluid of the structure or a portion thereof past or through the thermal storage chamber, and a mixing means in fluid communication with the thermal storage chamber and the thermal storage chamber bypass conduit for mixing the unheated fluid from the thermal storage chamber bypass conduit and the heated fluid from the thermal storage chamber to provide for storage of heat in the thermal storage chamber at a first predetermined higher temperature than desired for heating the interior of the structure while providing a second predetermined temperature fluid for space heating the interior of the structure by mixing the heated and unheated fluids. The thermal storage furnace system also includes fluid heating means in fluid communication with the thermal storage chamber and the mixing means and a fluid moving means in fluid communication with the mixing means for moving fluid within the thermal storage furnace system. The mixing means of the thermal storage furnace system further includes a fluid directing means for directing heated fluid through the thermal storage chamber in a first predetermined direction during the charging phase when heat is being transferred into the thermal storage chamber and in the opposite direction during the discharging phase when heat is being transferred out of the thermal storage chamber thereby achieving optimum counter flow effects within the thermal storage chamber. The mixing means of the thermal storage furnace system also includes a directed heated fluid discharge means in fluid communication with the thermal storage chamber and the thermal storage chamber bypass conduit for directing heated fluid in a predetermined direction into the unheated fluid flowing in the opposite direction exiting the thermal storage chamber bypass conduit to augment mixing of the heated and unheated fluids.

BRIEF DESCRIPTION OF THE DRAWINGS

The invention may be understood and further advantages and uses thereof more readily apparent, when considered in view of the following detailed description of exemplary embodiments, with the accompanying drawings, in which.

DESCRIPTION OF THE PREFERRED EMBODIMENTS

Figure 1:
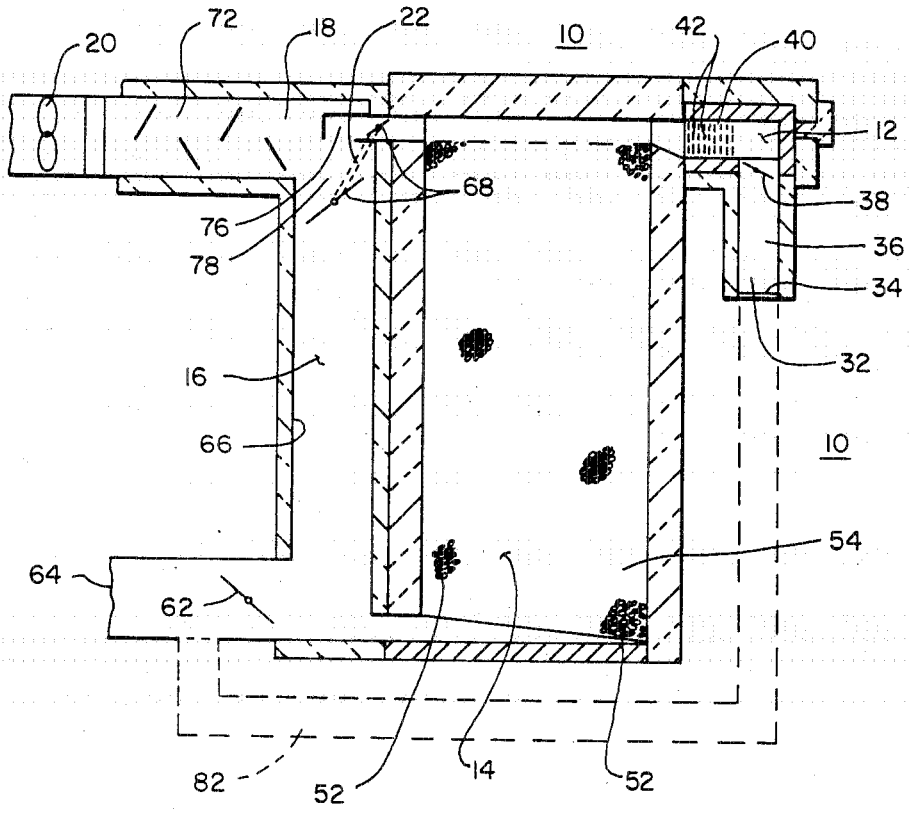
FIG. 1 is a cross-sectional view taken through a thermal storage furnace system constructed according to the teachings of the present invention.

Thermal storage system 10 includes heating means 12 for heating a fluid suitable for convective or conductive heating, such as for instance ambient air, thermal storage means 14 for transferring heat from the heated fluid and storing the transferred heat therewithin, thermal storage means bypass conduit 16 for bypassing thermal storage means 14 with unheated fluid such as for example from the cold fluid return of the interior volume of the structure or housing to be heated, mixing means 18 for mixing heated fluid from thermal storage means 14 or heating means 12 with unheated fluid from thermal storage means bypass conduit 16, fluid moving means 20 for moving fluid within thermal furnace storage system 10 and fluid directing means 22 for directing heated fluid through thermal storage means 14 in a first predetermined direction during the charging phase and in the opposite direction during the discharging phase. Thermal storage means 14 is in fluid communication with heating means 12. Thermal storage means bypass conduit 16 is adapted for fluid communication with the interior volume of a structure or housing to be heated.

Mixing means 18 is in fluid communication with heating means 12, thermal storage means 14 and thermal storage means bypass conduit 16. Fluid moving means 20 is in fluid communication with mixing means 18 and fluid directing means 22 is disposed in thermal storage bypass conduit 16.

Heating means 12 is for heating a fluid suitable for convention or conduction circulation through the interior volume of a structure or housing and includes charging branch 32 which consists of lint filter 34 standpipe 36 and thermal isolation damper 38, all in fluid communication with electric resistance heater 40 having electric resistance elements 42. Thermal storage means 14 for transferring heat from the heated fluid exiting heating means 12 and storing the heat transferred therefrom, includes multiple layers of trap rock 52. Trap rock 52, relative to other rock has high density, high specific heat, does not contain free quartz, is chemically inert, and is particularly strong and durable when cycled to temperatures as high as 1800° F. In addition, trap rock is currently produced in large quantities, thereby having a low material cost, and is widely distributed thereby having a low shipping cost. The multiple layers of trap rock 52 comprise storage chamber or bed 54 of thermal storage means 14. Thermal storage means bypass conduit 16 includes balancing damper 62, structure or housing interior volume cold fluid return 64, storage unit bypass line 66 and mixer damper 68. Mixing means 18 is for mixing the heated fluid from thermal storage means 14 or heating means 12 with the unheated fluid from the thermal storage means bypass conduit 16 to provide for storage of heat in the thermal storage means 14 to a first predetermined higher temperature than desired for heating the interior of the structure while providing a second predetermined temperature fluid for heating the interior of the structure by mixing the unheated fluid from the thermal storage means bypass conduit 16 with the heated fluid from the thermal storage means 14, and includes air mixer 72 and directed heated fluid discharge means 76 disposed in fluid communication with heating means 12, thermal storage means 14 and thermal storage means bypass conduit 16 for directing the heated fluid from heating means 12 and the heated fluid stored at the first predetermined high temperature within thermal storage means 14 in a predetermined direction opposite to the unheated fluid flowing within thermal storage means bypass conduit 16 to augment mixing of the heated and unheated fluids. Directed heated fluid discharge means 76 being further disposed immediately upstream of turn 78 of mixing means 18 to further augment heated and unheated mixing. If desired, thermal storage furnace system 10 may be converted to a totally closed system simply by placing charging branch 32 in fluid communication with cold fluid return 64 by means of, for example, a charging branch to cold air return conduit which is shown in FIG. 1 in phantom at 82.

The operation of thermal storage furnace system 10 consists basically of a charging phase and a discharging phase. The operation of thermal storage furnace system 10 will be described with reference to a warm air convection furnace system because the present invention was developed for such a system. The invention, however, is broadly applicable to thermal storage furnace systems employing any fluid both gaseous and liquid which is suitable for conveying heat within the system.

Referring again now to FIG. 1, the charging phase occurs during the utility's low load or off-peak time intervals and is initiated either by an internal clock or by a telemetric signal initiated by the host utility. This system has been designed so that the charging phase may by either continuous or intermittent i.e., the utility may elect to provide charge energy over, for example, two distinct 4 hour periods. The fan or fluid moving means is turned on which draws ambient are into the system and discharges it to the furnace plenum. The chamber or bed 54 of thermal storage means 14 has been designed to minimize pressure loss while assuring good flow distribution. The buoyancy vector opposes the flow momentum vector which it stabilizes for the heating mode (with upward flow, the buoyancy vector would be destabilizing). Upward flow of the discharge air is also stabilizing. This is important for low pressure loss beds where the buoyancy force is a significant (relatively) fluid body force. The fan or fluid moving means runs continuously during the charging cycle and draws air into the system from branches 32 and 64. The air drawn into the charging branch 32 passes through lint filter 34, up standpipe 36, past thermal isolation damper 38, and into electric resistance heater 40. Electric resistance elements 42, heat the air. The power to the heating elements is controlled to maintain a constant air temperature at variable air flow rates. The other option is to modulate flow which is a technically more difficult and costly alternative. This feature assures high utilization of the media storage capacity with simple, low cost flow control components.

The air is heated as it passes through the resistance heater 40 and flows downward into and through chamber bed 54 of thermal storage means 14. As the air passes through the chamber bed 54 its thermal energy is transferred to the trap rock, storage media 52, and is itself, cooled. When the charging air is leaving the thermal energy storage means 14 rises, the house fan is turned on. The unheated air in thermal storage means bypass conduit 16 (from cold fluid return air stream 64 mixes with the air leaving the bed). An acceptable flow split between the two air streams is passively maintained by an adjustable flow orifice flow 62. The combined air flows through thermal storage means bypass conduit 16, through mixer damper 68, mixing means 18, and into fan 20. A thermostat within the living space determines whether thermal energy for space heating is required.

If a spaced heating demand occurs during the charging the time interval, mixer damper 68 opens to pass part of the hot air leaving the electric resistance heater so that the desired air temperature and flow for space heating is achieved at the exit of mixing means 18. In this mode mixing means 18 blends the hot air stream and the colder air stream from the thermal storage means bypass conduit 16 to provide a uniform temperature air stream for space heating at the desired temperature level. The charging phase is terminated by an internal clock, by a telemetric signal, or if the mixed air temperature in the bypass line exceeds a predetermined temperature limit.

During the discharging phase the charging air branch 32 is isolated by a flow restriction, such as for example by closure of a thermal isolation damper 38. The fan is started upon a demand from the house thermostat. All of the air is cold return air. The air stream then splits into two streams. One stream flows through the bypass line to the air mixing plenum 68. The other stream enters thermal storage means 14 and flows upward through the bed 54 (in the opposite direction to that of the charging flow in order to achieve optimum counterflow effects). This air is convectively heated by the transfer of thermal energy stored in the rock to the air. The heated air leaves thermal storage means 14 and passes through the hot leg of air mixer damper 68. Mixer damper 68 regulates the flow split between the two air streams in order to achieve the desired temperature in the combined air stream downstream of the air mixing plenum a mixing means 18.

The flow paths, damper arrangement, and operation during the charging phase were selected to best utilize the element storage means 14 capacity. As the charging phase progresses the temperature of the air leaving the bottom of the storage chamber 54 at opening 80 slowly rises. Ultimately the temperature will exceed the allowable temperature for the house air distribution system and the charging phase must be stopped. By using fan capacity in order to draw in a second air stream of unheated air at cold fluid return 64, time of cessation of the charging phase is significantly delayed. Therefore, more energy can be stored and cost reduced.

Figure 2:
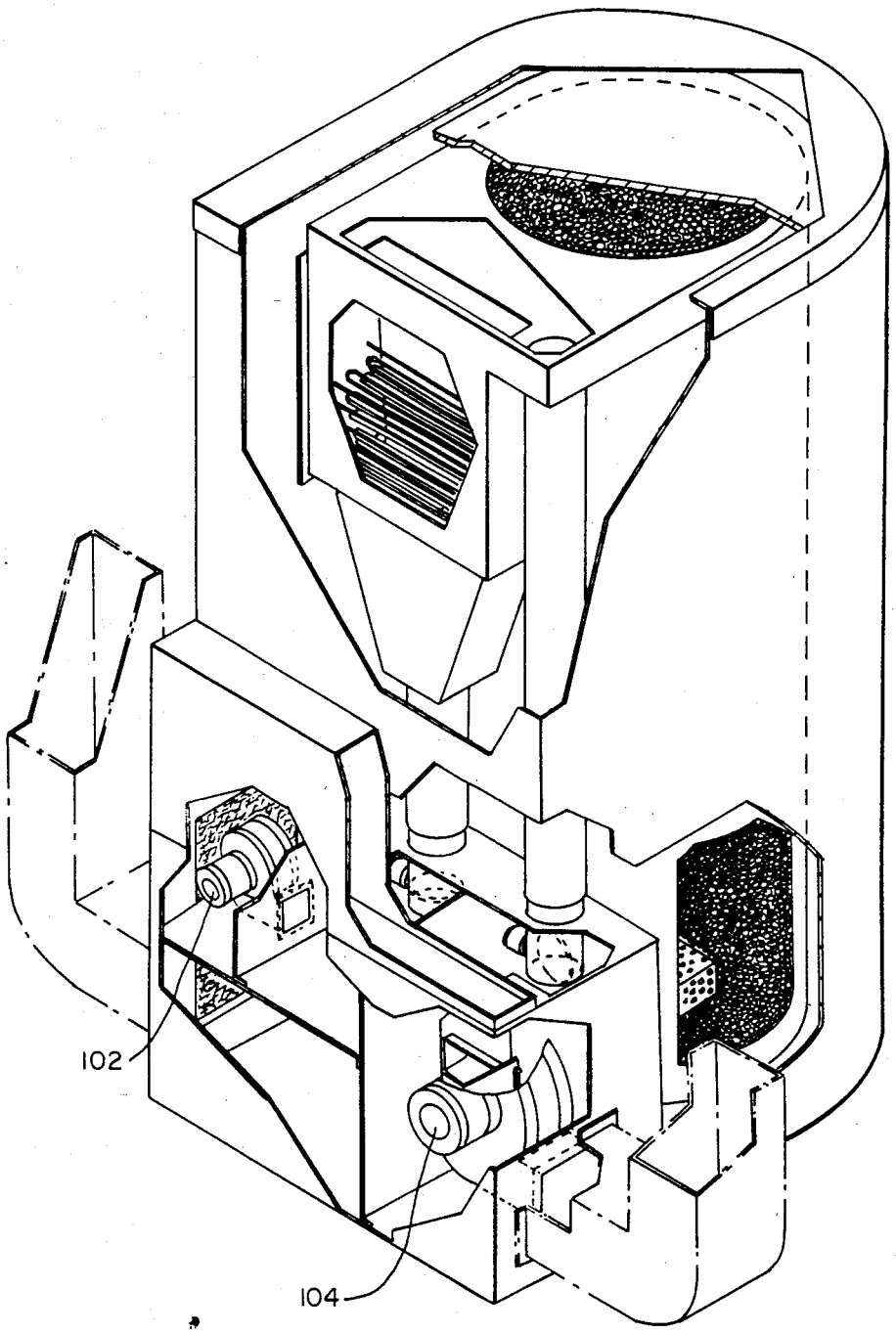
FIG. 2 is an isometric view with parts broken away of a preferred embodiment of a thermal storage furnace system constructed according to the teachings of the invention.

Referring now to FIG. 2, there is shown an isometric view with parts broken away of a preferred embodiment of the thermal storage furnace system constructed according to the teachings of the invention. Thermal storage furnace system 100 utilizes a two-fan arrangement, charge fan 102 for charging the thermal storage means and house fan 104 for moving the heated fluid throughout the thermal storage furnace system and structure or housing to be heated. Thermal storage system 100 again has two primary modes or phases, charging and discharging, each day of the heating season. The operation of thermal storage furnace system 10 will be described relative to a residential central air heating configuration as before. Warm air is generated within the storage furnace on demand by the time residence thermostat in either of these phases of the daily cycle. Circulation of cold return air from the residence to the furnace and, distribution of warmed air from the furnace to the residence is accomplished by the activation of the house fan 104 in a manner similar to conventional central air furnaces.

The charging phase occurs during the utility's low load or off-peak time intervals and is initiated either by an internal clock or by a telemetric signal by the host utility. This heating system has designed so that the charging phase may be continuous or intermittent. Furthermore, numerous charging and discharging modes interspersed throughout the day can be accommodated by the system.

Figure 5:
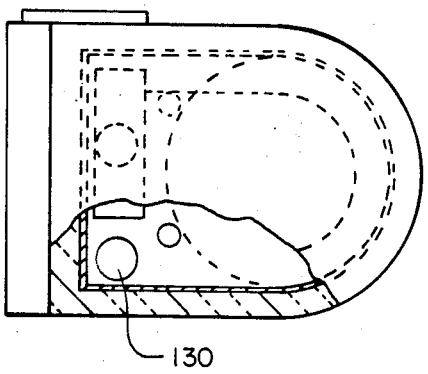
FIG. 5 is a top view with a portion broken away of the thermal storage furnace system preferred embodiment of FIG. 2.
Figure 4:
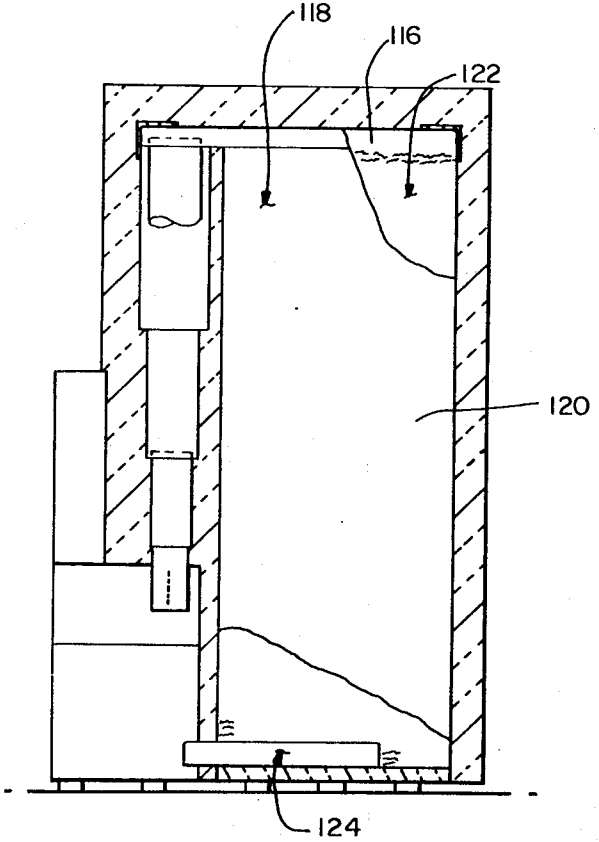
FIG. 4 is a side cross-sectional view of the thermal storage furnace system preferred embodiment of FIG. 2.
Figure 3:
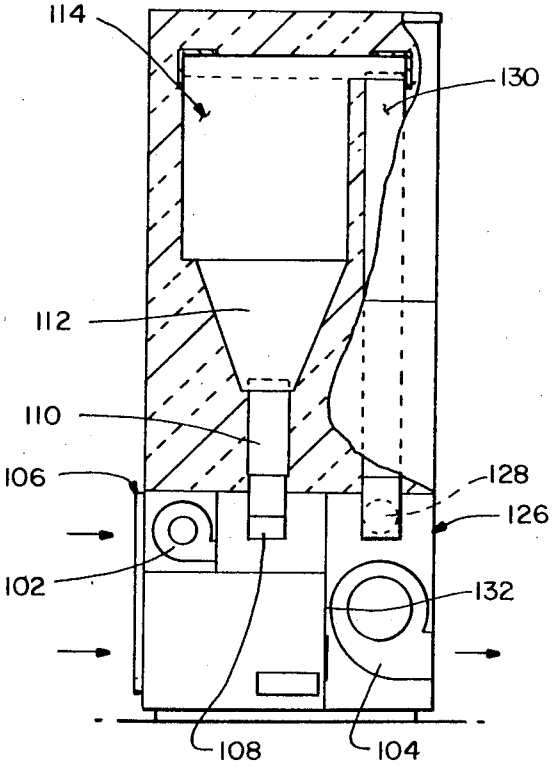
FIG. 3 is a front cross-sectional view of the preferred embodiment of the thermal storage furnace system of FIG. 2.

Referring now to FIGS. 3, 4 and 5, at the beginning of a charge phase ambient air is drawn into the furnace through an inlet filter 106 by the charging fan 102. The air leaves the fan and flows through an optional, wide open, resistance heater shutoff damper 108, through an interconnecting pipe 110 and through a distribution manifold 112 to an electric resistance heater 114. The resistance heater accepts off-peak electric power, converts it to thermal energy, and delivers the thermal energy to the flowing charge air stream. The hot air leaves the electric resistance heater and enters the upper plenum 116 of the thermal storage vessel 118.

The storage vessel encloses the thermal energy storage bed 120 which consists of low cost storage media 122 such as crushed basalt rock or natural basalt pebbles. The hot air flows downward through the bed, heats the storage media, and is, itself cooled. The rock bed is such a good receiver of heat that the air temperature leaving the storage vessel is at or near ambient temperature except near the end of the charge phase of the most severe heating days. In order to maximize the amount of stored energy for these peak heating days of the heating season, the air temperature at the bottom of the storage is allowed to rise above the normal warm air delivery temperature to the residence. At this condition the house fan is turned on so as to mix cold return air with the air leaving the storage bed. Approximately 20% more thermal energy can be stored within the bed without increase in heating system size and cost, and without adverse effect on residents with regard to temperature or sensation of drafts. It may be noted that the downward flow of hot air through the bed with respect to gravity at low total bed pressure loss permits the buoyancy force to stabilize and balance the air flow (and, therefore, the temperature ) distribution within the storage bed. The air is discharged from the bottom plenum of the storage vessel 124 into the air mixing plenum 126. This exiting air stream is allowed to dissipate through the house ducting when its temperature is low. At higher discharge temperature the house fan is on and the tempered air mixture is forced through the warm distribution ducts (at an acceptable temperature level).

If the residence thermostat initiates a demand for heat at any time during the charging phase, the house fan is turned on and the hot air temperature control damper 128 opens to allow part of the hot charge air flow leaving the resistance heater to bypass the bed through the hot air duct 130. This hot air damper modulates in order to provide the desired air temperature to the residence through the warm air ducting. The furnace has been designed to provide a continuous supply of warm during the charging phase while fully charging the storage bed.

During the normal discharge phase, the charge circuit flow elements (charge fan, isolation damper, and resistance heater) are deactivated. On demand for residence heat, the house fan is turned on and the hot air damper opens. A fixed adjustable air flow orifice 132 is provided to cause cold return air from the residence to split into two parallel streams. The larger of two streams passes through the orifice 132 into a mixing plenum. The smaller of the two air streams enter the storage vessel through the lower plenum from whence it flows upward through the bed. The air is heated by its passage through the storage media, and the storage media is, itself, cooled. The heated air leaves there storage vessel via the upper plenum and flows downward through the hot air duct to join and mix with the other cold air stream. The hot air damper modulates the air flow rate through the bed in order to provide the desired temperature of the warm air to be distributed through the residence heating system.

Utilization of this two-fan arrangement and the adjustable air flow orifice simplifies, and minimizes the cost of the air flow control components and controller logic. Only one modulating damper 128 is required for furnace function, while achieving the desired, high efficiency counterflow effects within the storage bed. The optional resistance heater isolation damper can be replaced by a flow restriction which serves to limit flow through that path during the discharge phase. A moderate amount of flow through does not diminish thermal performance of the furnace and does favorably mitigate thermal exposure of the hot air damper.

Figure 6:
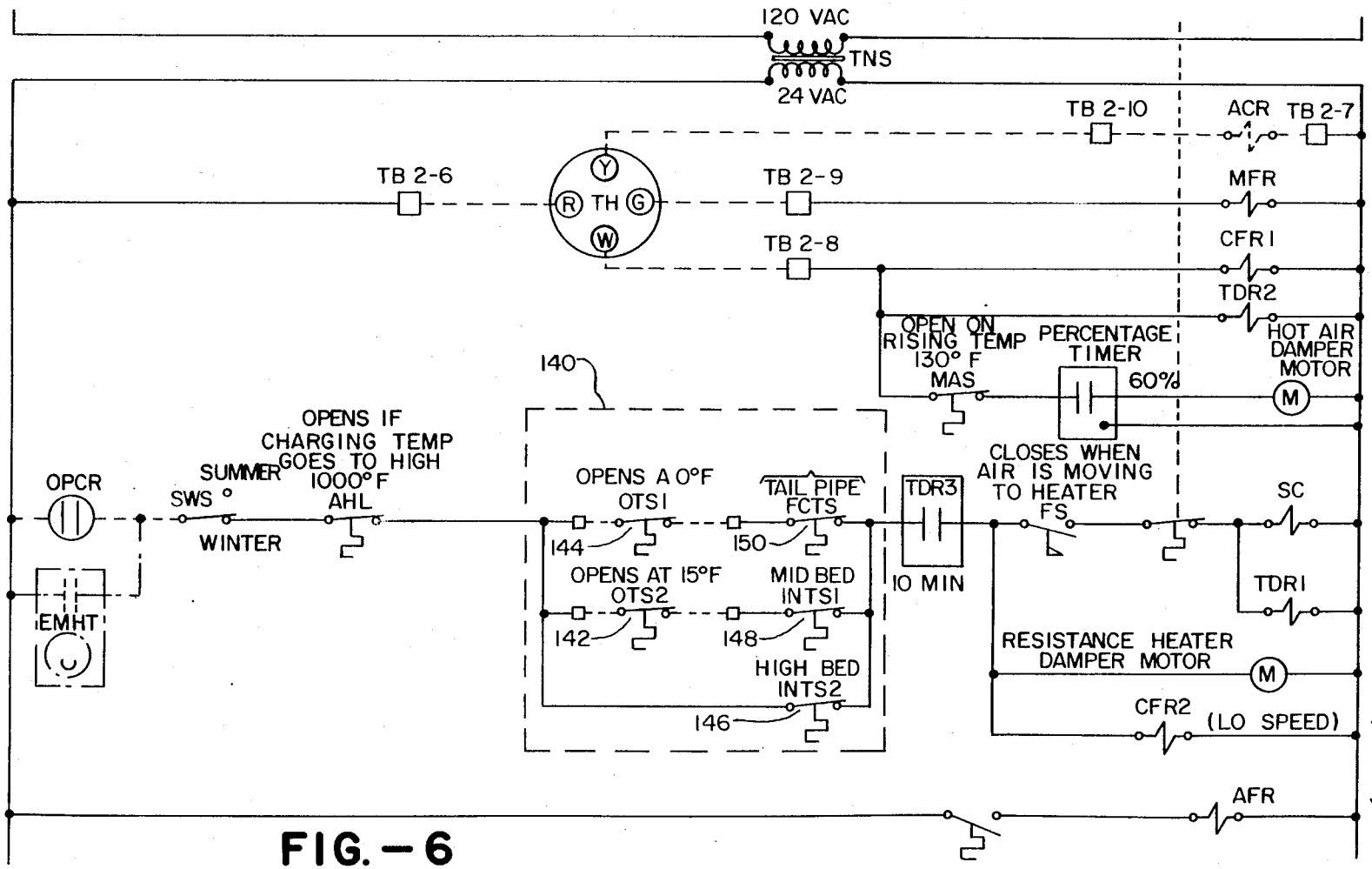
FIG. 6 is a schematic diagram of a control circuit for use with the thermal storage furnace system preferred embodiment of FIG. 2.

Referring now to FIG. 6, a schematic diagram of the furnace control system constructed according to the teachings of the invention is shown. Attention should be given to the novel charge level control subcircuit 140. With this simple circuit of thermal switches, incremental levels of charge can be achieved in response to outdoor conditions throughout the course of the heating season. As shown, the circuit is comprised of two switches 142 and 144 respectively, which may be located on the exterior and three switches 146, 148 and 150 respectively, which may be positioned on the storage vessel or thermal storage means along its axis. If the outdoor temperature is moderate (for example above 15 F.), a higher setpoint switch 142 triggers. In this state the charging air circuit is disabled as soon as the topmost temperature switch 146 on the storage vessel triggers at a predetermined temperature setpoint, thus charging stops at a reduced amount of stored energy (approximately 45%). The bottom of the storage bed remains at near residence interior temperature an no appreciable heat is conveyed to the residence as a result of the charge air flow leaving the storage vessel. If the outdoor temperature is intermediate (for example, above −5 F.), the second, lower setpoint switch 144, on the exterior of the house triggers. In this state, the charging air circuit is disabled as soon as the middle position, axially, switch 148 on the storage vessel triggers at a predetermined temperature setpoint. Thus charging stops at approximately 80% of the amount of the maximum design heat level. The bottom of the storage bed and the charge exiting the storage vessel never rises above the normal warm air delivery temperature for central heating systems. A finite, but small amount of thermal energy is conveyed to the residence which is commensurate with the rate of thermal energy consumption of the residence at these outdoor temperature conditions. Finally, independent of outdoor temperature, and the third temperature switch 150 on the storage vessel (located at the bottom of the storage vessel) will disable the charging air circuit when it triggers at its temperature setpoint, and thereby affecting the full charge state at maximum design storage.

This control scheme optimizes furnace function with the use of low cost and high reliability components. It does not require the use of conventional temperature sensors, signal conditioning, and logic devices, as is, by comparison, very cost effective and rugged. The specific temperature setpoints of the five temperatures switched can be selected to meet the needs of arbitrary climatic zones.

The storage vessel 118 is of cylindrical, thin shell constructio2n permitting economical use of material while providing adequate mechanical strength to withstand cylical mechanical forces. These forces result from the effects of differential expansion between the storage vessel material and the storage media. The vessel is externally insulated 152 so that low cost thermal insulation may be used. The optimum insulation is vermiculite granules because of cost, performance, and allowable service temperature range. Because these granules may compact and settle over time, a high performance insulation gives adequate secondary thermal hazard protection even at excessive compaction of the granular insulation.

In conclusion, what has been disclosed is a thermal storage furnace system having a mixing means in fluid communication with both a thermal storage means and a thermal storage means bypass conduit for mixing both heated fluid from the thermal storage means and unheated fluid from the thermal storage means bypass conduit to provide for storage of heat in the thermal storage means at a first predetermined higher temperature than desired for heating the interior of the structure, while providing a second predetermined temperature fluid for space heating the interior of the structure by mixing the heated fluid from the thermal storage means with the unheated fluid from the thermal storage means bypass conduit. The means of mixing the heated and unheated air according to the teachings of the invention are such that only a single low cost air moving means is required and that the thermal storage means may have heat transferred to it for an extended period of time and rise to a storage temperature much higher than that desired for heating the interior of a desired structure or housing. These advantages result in a significant cost reduction for the thermal storage furnace system. Another major cost reduction, results from the use of a rock bed as the storage medium for the thermal storage means. Trap rock, a material with low material costs and wide distribution have been identified, by test as having uniquely suitable properties for the heat storage medium.

I claim:

1. A thermal storage furnace system for heating the interior volume of a structure or housing by means of circulating a heated fluid, comprising:

(a) a heating means for heating a fluid;

(b) a thermal storage means disposed in fluid communication with said heating means for transferring heat from said heated fluid and storing said transferred heat, and for transferring said stored heat to an unheated fluid;

(c) a thermal storage means bypass conduit disposed in fluid communication with a source of unheated fluid for bypassing unheated fluid past said thermal storage means; and (d) a mixing means in fluid communication with said thermal storage means and said thermal storage means bypass conduit for mixing said heated fluid from said thermal storage means with said unheated fluid from said thermal storage means bypass conduit to provide for storage of heat in said thermal storage means at a first predetermined higher temperature than desired for heating the interior of said structure while providing a second predetermined temperature fluid for heating the interior of said structure;

(e) a fluid directing means disposed in said thermal storage means bypass conduit for directing heated fluid through said thermal storage means in a first predetermined direction during the charging phase when heat is being transferred into said thermal storage means and in the opposite director during the discharging phase when heat is being transferred out of said thermal storage means to provide optimum counterflow effects within said thermal storage means;

(f) said mixing means includes a directed heated fluid discharge means disposed in fluid communication with said thermal storage means and said thermal storage means bypass conduit for directing said heated fluid stored at said first predetermined high temperature within said thermal storage means in a third predetermined direction into the fluid flowing in a fourth direction within said thermal storage means bypass conduit to augment mixing of said heated and unheated fluid, said directed heated fluid discharge means being located to discharge said heated fluid immediately upstream of a turn within said mixing means to further augment fluid mixing;

said thermal storage means having first and second ends, said first end being in fluid communication with said mixing means and said heating means and said second end being in fluid communication with the thermal storage means bypass conduit to provide for routing said heated fluid from said heating means through said first end, then said second end of said thermal storage means and into said thermal storage means bypass conduit to provide for mixing said heated fluid exiting said second end of said thermal storage means with said unheated fluid within said thermal storage means bypass conduit to provide for heating said thermal storage means to said first predetermined higher temperature, while providing a second predetermined temperature fluid for heating the interior of the structure by combining said heated fluid exiting said second end of said thermal storage means with said unheated fluid from said thermal storage means bypass conduit and delivering said combined heated and unheated fluids to said mixing means for mixing said heated and unheated fluids.

2. The thermal storage system of claim 1 wherein said thermal storage means is filled with trap rock to provide a high capacity storage medium per unit of volume having a high density, high specific heat, quartz free, chemically inert, strong and durable storage medium suitable for cycling up to 1800° F. temperatures.

3. The thermal storage furnace system of claim 2 further including a heating means for heating said fluid disposed in fluid communications with said thermal storage means and a fluid moving means disposed in fluid communication with said mixing means for moving fluid within said thermal storage furnace system.

4. A thermal storage furnace system for heating the interior volume of a structure or housing by means of circulating a heated fluid, comprising:

(a) a heating means for heating a fluid;

(b) a thermal storage means having a top portion, a middle portion and a bottom portion disposed in fluid communication with said heating means for transferring heat from said heated fluid and storing said transferred heat, and for transferring said stored heat to an unheated fluid;

(c) a charge fan for moving unheated fluid through said heating means and into said thermal storage means; and (d) a charge level control subcircuit including 1st and 2nd outdoor thermal switches disposed in thermal communication with the external temperature of the structure to be heated for electrically open circuiting in response to 1st and 2nd predetermined outdoor temperatures, respectively, and 1st, 2nd and 3rd storage vessel thermal switches for electrically open circuiting inresponse to 1st, 2nd and 3rd predetermined storage vessel temperatures, respectively, said 1st and 2nd storage vessel thermal switches being disposed in thermal communication with the middle and bottom of the thermal storage means respectively and electrically in series with said 1st and 2nd outdoor thermal switches respectively, said 3rd storage vessel thermal switch being disposed in thermal communication with the top of the thermal storage means and electrically in parallel with each of the series combinations of said 1st outdoor and storage vessel thermal switches and said 2nd outdoor and storage vessel thermal switches, respectively, said charge fan and said heating means being disposed electrically in series with and controlled by said charge level control subcircuit to provide for 1st, 2nd and 3rd predetermined levels of charge in said thermal storage means in response to whether the exterior temperature of the structure to be heated is higher than, in between, or lower than said 1st and 2nd predetermined outdoor temperatures respectively.

* * * * *